US008057071B2

(12) United States Patent
He et al.

(10) Patent No.: US 8,057,071 B2
(45) Date of Patent: Nov. 15, 2011

(54) END-SIDE HEAT EXTRACTION LIGHT EMITTING DIODE (LED) LAMP

(75) Inventors: Sin-Wei He, Jhudong Township, Hsinchu County (TW); Jhong-Yan Chang, Hsinchu County (TW)

(73) Assignee: Forcecon Technology Co., Ltd., Chu Pei, Hsin Chu Hsien (TW)

( * ) Notice: Subject to any disclaimer, the term of this patent is extended or adjusted under 35 U.S.C. 154(b) by 276 days.

(21) Appl. No.: 12/347,224

(22) Filed: Dec. 31, 2008

(65) Prior Publication Data

US 2010/0020537 A1 Jan. 28, 2010

(30) Foreign Application Priority Data

Jul. 25, 2008 (TW) ..... 97213281 U

(51) Int. Cl.
*F21V 29/00* (2006.01)

(52) U.S. Cl. ..... 362/294; 362/234; 362/249.02; 362/373; 362/800

(58) Field of Classification Search ..... 362/234, 362/249.02, 294, 373, 800
See application file for complete search history.

(56) References Cited

U.S. PATENT DOCUMENTS

| | | | | |
|---|---|---|---|---|
| 7,144,140 | B2 * | 12/2006 | Sun et al. | 362/373 |
| 7,819,556 | B2 * | 10/2010 | Heffington et al. | 362/294 |
| 2006/0215408 | A1 * | 9/2006 | Lee | 362/294 |

* cited by examiner

*Primary Examiner* — Diane Lee
*Assistant Examiner* — Mary Zettl
(74) *Attorney, Agent, or Firm* — Egbert Law Offices PLLC

(57) ABSTRACT

The present invention provides an end-side heat extraction light emitting diode or LED lamp. The LED lamp includes a lamp housing, a cooling module, and an LED lighting set. The cooling module is configured inside the housing space of the lamp housing, having a cooling fan and a cooling base. The LED lighting set is configured on the LED joint surface of the cooling base. The end-side heat extraction LED lamp also includes a circular frame and an end-side heat extraction airflow guidance passage. The circular frame forms a space extending and expanding to the end side. The end-side heat extraction airflow guidance passage forms an airflow guidance space extending and expanding to the end side, forming a heat radiating path where the heat extraction airflow generated by the running cooling fan of the LED lamp can be exhausted from the light projection end of the lamp housing.

7 Claims, 8 Drawing Sheets

END-SIDE HEAT EXTRACTION LIGHT EMITTING DIODE (LED) LAMP

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a light emitting diode (LED) lamp, and more particularly to an LED lamp which adopts an innovative configuration enabling end-side hot air extraction for better heat radiating efficiency.

2. Description of Related Art Including Information Disclosed Under 37 CFR 1.97 and 37 CFR 1.98.

Compared with traditional lamps, LED lamps have such advantages of lower energy consumption and a longer lifespan. LED lamps are therefore enjoying an increasingly higher market share.

However, with respect to structure to meet the demand for higher brightness, LED lamps must improve the configuration of the LEDs. When the number of LEDs reaches a certain scale, the lighted lamp will generate a high temperature, which may affect the lifespan and safety of the components. Hence, the heat extraction mechanism is a very important concern for high-brightness LED lamps.

In the prior-art LED lamp heat radiating structures, the LEDs are configured on a radiator base, and some heat radiating holes are configured on the periphery of the LED lamp housing to extract the hot air. However, such a heat radiating structure is a passive solution as it cannot forcibly and effectively remove the heat absorbed by the radiator base. The low heat radiating efficiency cannot meet the demand of high-brightness and high efficiency LED lamps.

There is another kind of prior-art LED lamp heat radiating structure, as shown in FIG. 1. It adds a cooling fan 12 at a corresponding position on the radiator base 11 of the LED lamp 10. When the cooling fan 12 is running, it will generate an airflow W to forcibly eject the hot air. On the spaced periphery of the LED lamp 10, air exit holes 14 and air inlet holes 15 are configured.

However, such a prior art LED lamp heat radiating structure still has the following problems. As the radiating surface 13 on the side of the radiator base 11 for configuration of the cooling fan 10 is planar, when the cooling fan 12 is running, the airflow W driven by the cooling fan 12 will hit the radiating surface 13 and then make a lateral turn and be ejected through the air exit holes 14 configured on the periphery of the LED lamp 10. However, as the air inlet holes 15 configured on the periphery of the LED lamp 10 are very close to the aforementioned air exit holes 14 (generally only approximately a 3cm spacing), the hot airflow W ejected from the air exit holes 14 will easily be absorbed again into the LED lamp 10 from the air inlet holes 15, or from the lateral side of the air exit holes 14, causing a circulation of the hot airflow W. As a result, it will be difficult for the cooling fan 10 to let in cool air, and the heat radiating efficiency as well as performance will definitely and greatly be affected.

In addition, as shown in FIG. 2, when the lamp set (such as a pendant lamp set) installed with the LED lamp 10 has a lampshade 16 to enclose the LED lamp 10, the ejected hot airflow W generated by the aforementioned prior-art LED lamp 10 will be blocked by the lampshade 16, causing an aggravated circulation of the hot airflow W. Hence, extraction of the hot air becomes more difficult.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

Through the innovative and unique present invention, there is an end-side heat extraction LED lamp comprising an end-side flow guidance surface and a circular frame. The present invention has an advantage over prior art structures in that the heat extraction airflow generated by the running cooling fan of the LED lamp can be exhausted through the end-side heat extraction airflow guidance passage, forming a heat radiating path where the hot airflow is exhausted from the light projection end of the lamp housing. This realizes a practicable advancement in avoiding backflow of the hot air and enhancing the heat extraction efficiency.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
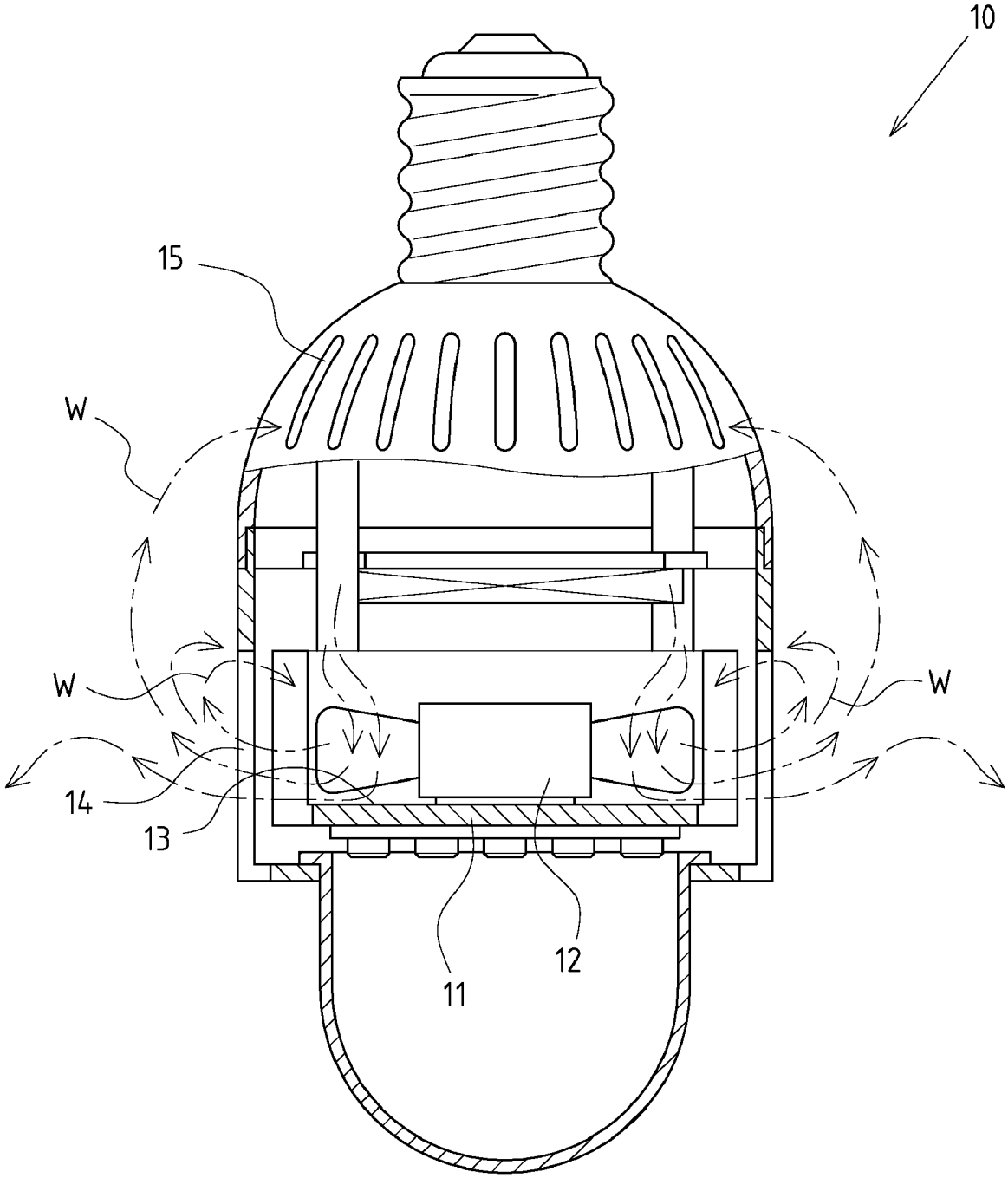
FIG.1 PRIOR ART
FIG. 1 shows a schematic view of the prior art LED lamp heat radiating structure.
Figure 2:
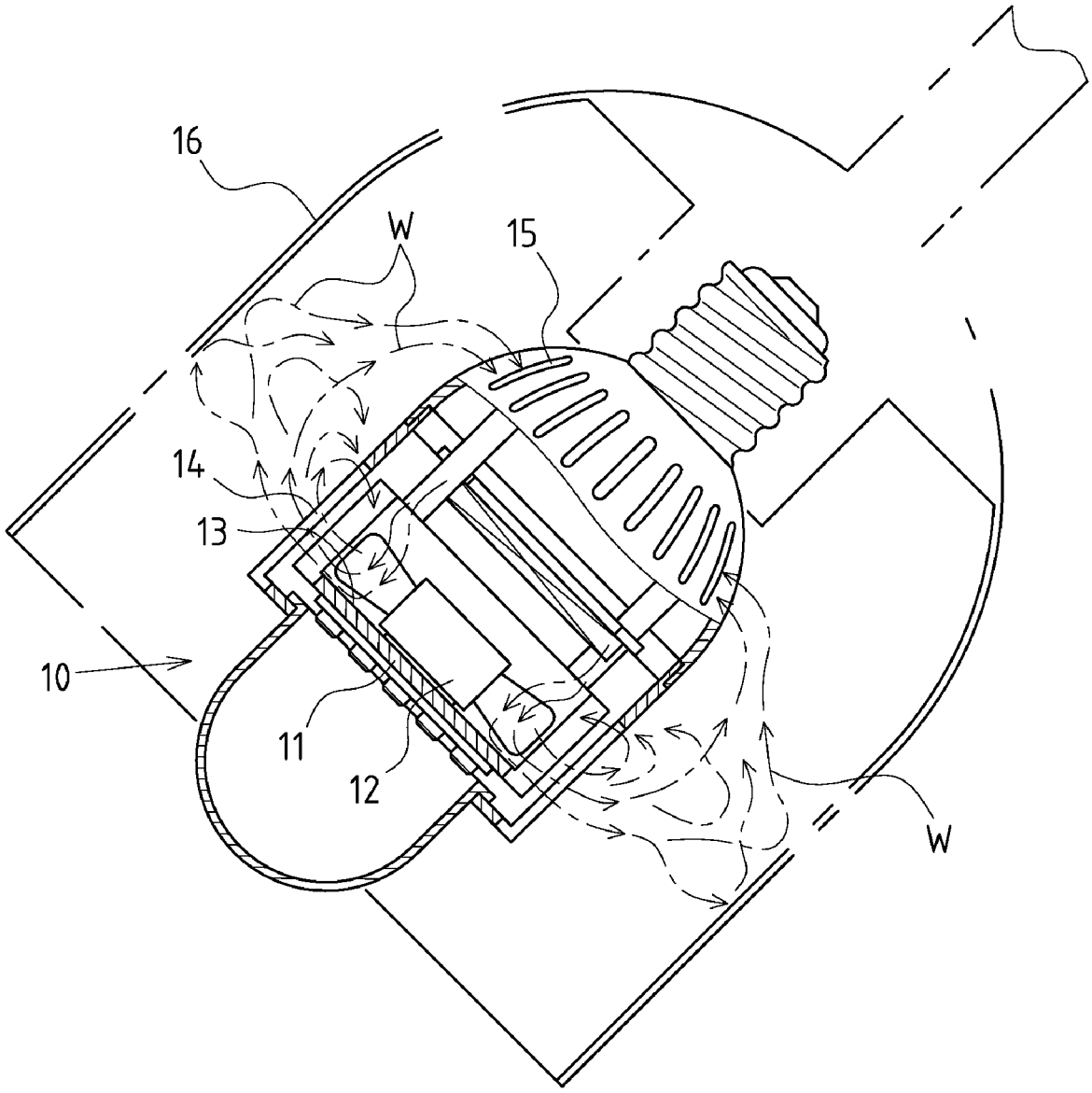
FIG.2 PRIOR ART
FIG. 2 shows a perspective view of the structure of prior art LED lamp and the status of airflow.
Figure 3:
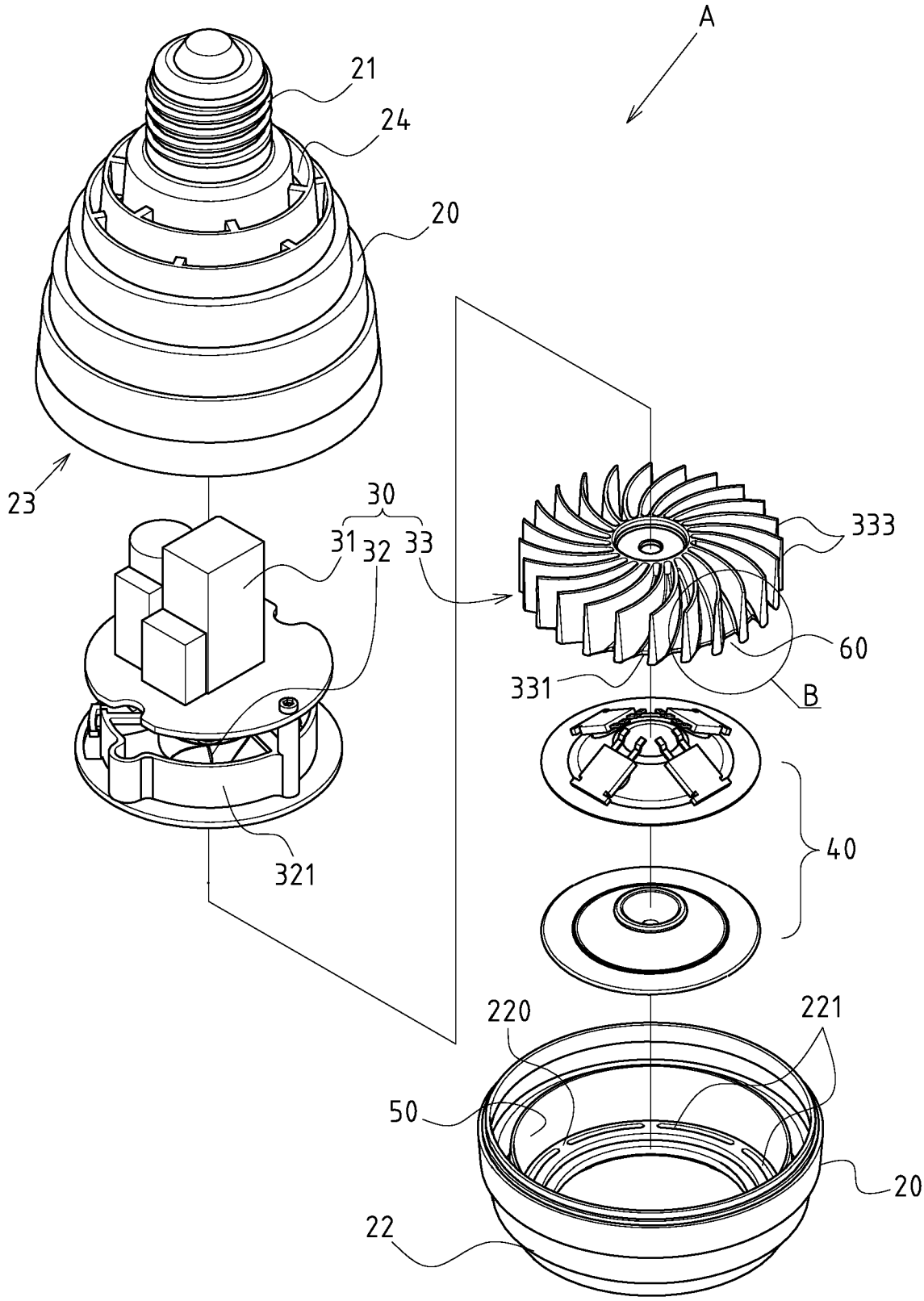
FIG. 3 shows an exploded perspective view of the preferred embodiment of the present invention.
Figure 4:
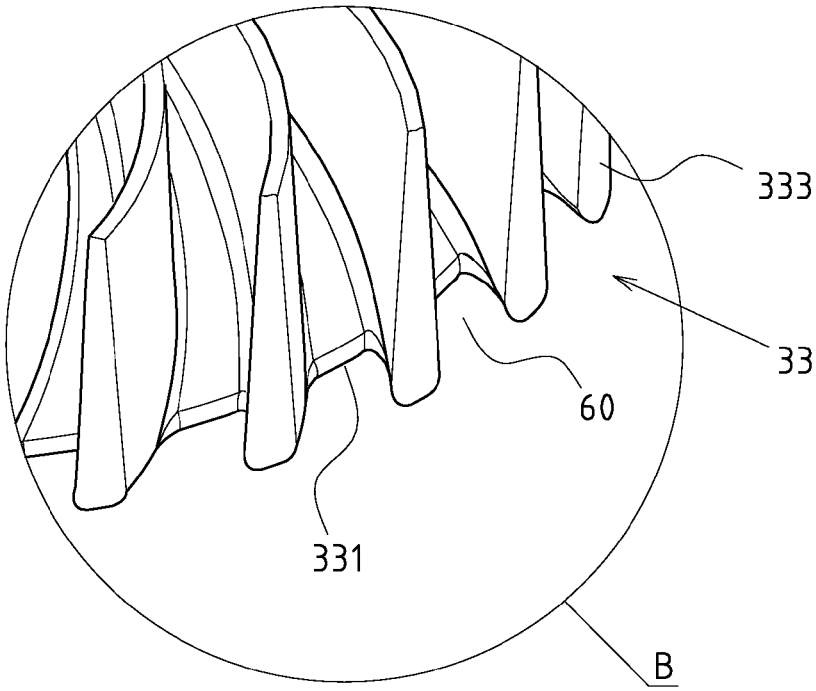
FIG. 4 shows an enlarged perspective view of Part B in FIG. 3.
Figure 5:
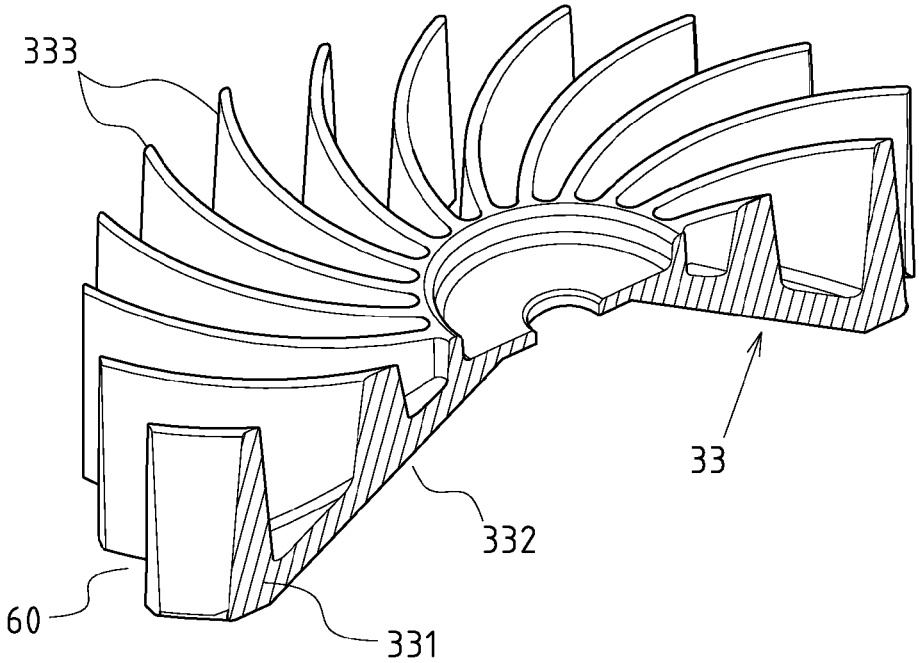
FIG. 5 shows a sectional perspective view of the cooling base of the present invention.

FIGS. 3, 4 and 5 disclose a preferred embodiment of the end-side heat extraction LED lamp of the present invention. While such an embodiment is for description purposes only, application of the patent shall not be restricted to such a structure.

The LED lamp A is comprised of a lamp housing 20, comprising an electric connection adapter 21 (may be screw type), a light projection end 22 and an inner housing space 23. The housing space 23 is close to one side of the electric connection adapter 21 and is configured with a vent hole 24.

There is a cooling module 30, configured within the housing space 23 of the lamp housing 20, comprising a circuit module 31, a cooling fan 32 and a cooling base 33. The cooling fan 32 is configured between the circuit module 31 and the cooling base 33. The cooling fan 32 has an airflow guidance frame 321. The cooling base 33 has a pedestal 331, an LED joint surface 332 and multiple fins 333.

The invention includes an LED lighting set 40, configured on the LED joint surface 332 of the cooling base 33.

The invention also includes a circular frame 50, shaped by extension of the airflow guidance frame 321 of the cooling fan 32 to the light projection end 22 of the lamp housing 20.

At least an end-side heat extraction airflow guidance passage 60 is configured between the circular frame 50 and the pedestal 331 of the cooling base 33. The inner side of the end-side heat extraction airflow guidance passage 60 corresponds to the cooling fan 32, while the outer side points to the end side of the light projection end 22 of the lamp housing 20, making the end-side heat extraction airflow guidance passage 60 into an airflow guidance space that extends and expands to the end side.

Therein, as shown in FIG. 3, the circular frame 50 can be shaped by extending integrally the inner wall of the light projection end 22 of the lamp housing 20 toward the inside.

Figure 8:
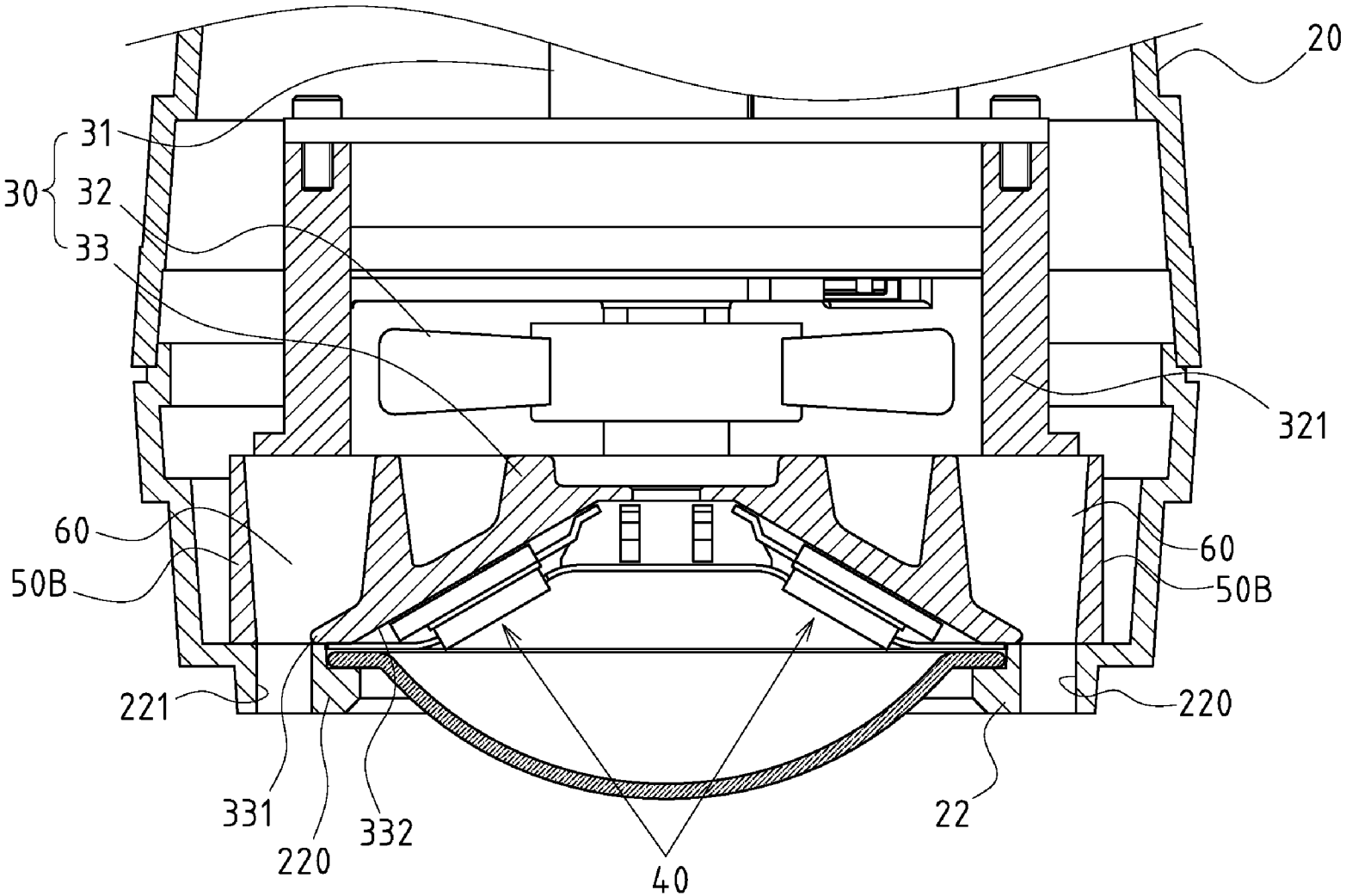
FIG. 8 shows a schematic view of another embodiment of the circular frame of the present invention.

Therein, as shown in FIG. 8, the circular frame 50B can also be shaped integrally on the periphery of the cooling base 33. In a combination type, the circular frame 50 can also be an independent component, and then be fixed on the inside of the light projection end 22 of the lamp housing 20.

Figure 6:
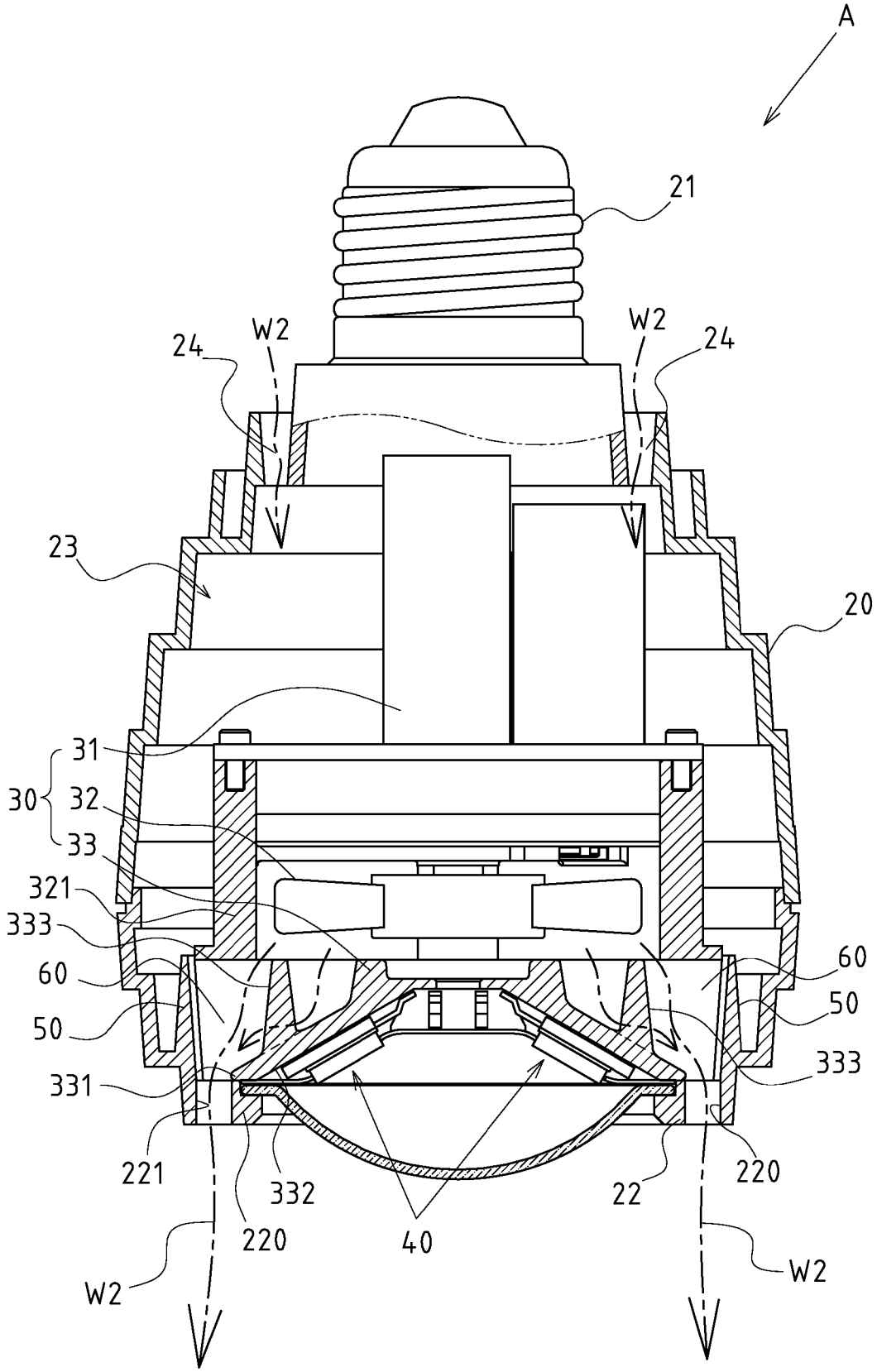
FIG. 6 shows a combined sectional plan view of the preferred embodiment of the present invention.

Therein, as shown in FIG. 6, the light projection end 22 of the lamp housing 20 can also be configured with a ring-shaped edge 220 supported on the outside end of the cooling base 33, and the ring-shaped edge 220 is configured with through holes 221 aligned to the end-side heat extraction airflow guidance passage 60.

The aforementioned structure constitutes the design of the present invention. Below are descriptions of the working status of the present invention.

Referring to FIG. 6, when the LED lamp A is lighted and working, the cooling fan 32 can be automatically and simultaneously started through settings in the circuit module 31. Through rotation of the cooling fan 32, when passing the cooling fan 32, the airflow W2 imported from the vent hole 24 will be guided through the end-side heat extraction airflow guidance passage 60 to the side of the cooling base 33. Then, the airflow W2 will be further guided through the end-side heat extraction airflow guidance passage 60 along a straight path to the end side until it is discharged out of the through hole 220. In this way, the path and direction of the exhausted airflow W2 is far from the vent hole 24, and therefore the problem of backflow of the hot air can be effectively avoided.

Figure 7:
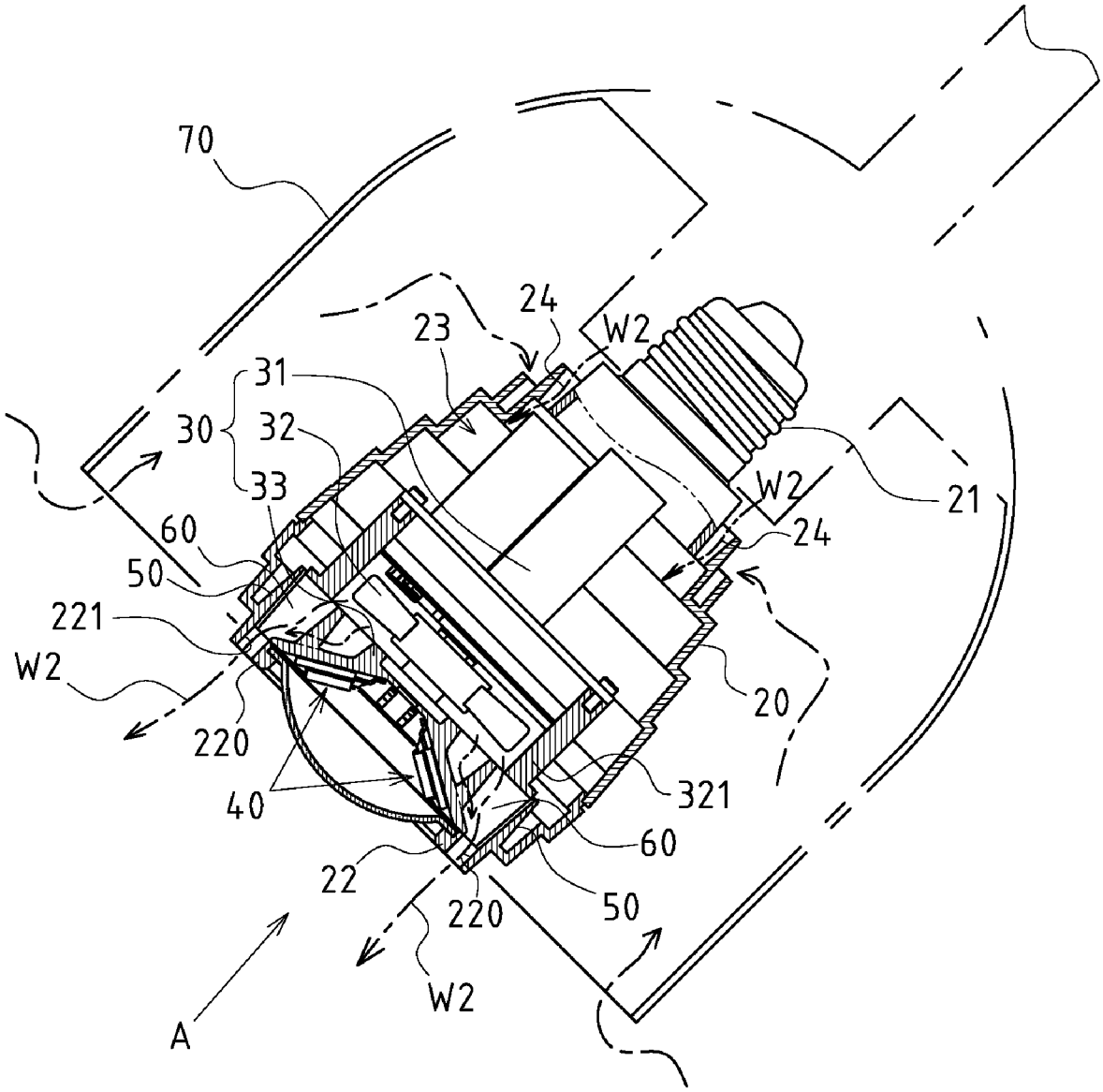
FIG. 7 shows a schematic view of one application and implementation of the present invention.

Furthermore, as shown in FIG. 7, when the object installed with the LED lamp A has an outer housing 70 to enclose the LED lamp A, the heat-extraction airflow generated by the running cooling fan 32 of the LED lamp A will be exhausted through the end-side heat extraction airflow guidance passage 60, forming a heat radiating path where the hot airflow is exhausted from the light projection end 22 of the lamp housing 20. This avoids the problem of stagnation of the hot airflow within the outer housing 70 and difficulty of discharge.

Therein, as shown in FIGS. 3 and 4, the edges of the fins 333 configured on the cooling base 33 can be protruded out of the edges of the pedestal 331 of the cooling base 33, so that the through space defined by the edges of the fins 333 and the edges of the pedestal 331 can form the end-side heat extraction airflow guidance passage 60.

Figure 9:
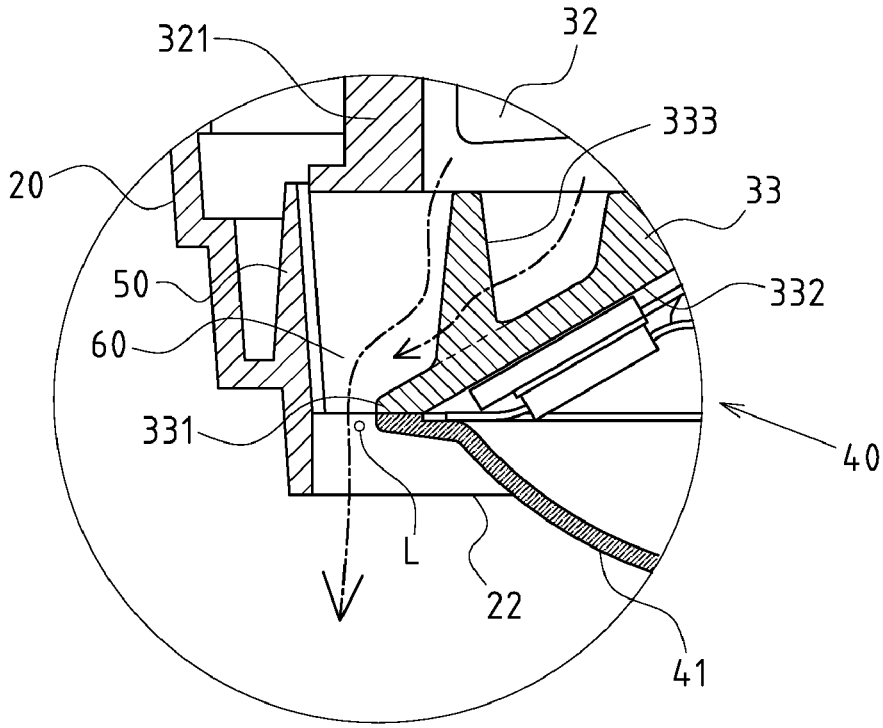
FIG. 9 shows a perspective view of another variation of the end-side heat extraction airflow guidance passage of the present invention.

Moreover, actual implementation of the configurations of the end-side heat extraction airflow guidance passage 60 can be of various forms. In the preferred embodiment disclosed in FIG. 9, the LED joint surface 332 of the cooling base 33 can also be configured with a refraction mirror 41. The edge of the refraction mirror 41 is set against the edge of the pedestal 331 of the cooling base 33. Moreover, there is spacing between the edge of refraction mirror 41 and the circular frame 50, forming a flow space aligned to the end-side heat extraction airflow guidance passage 60 (as marked L in the Figure).

Figure 10:
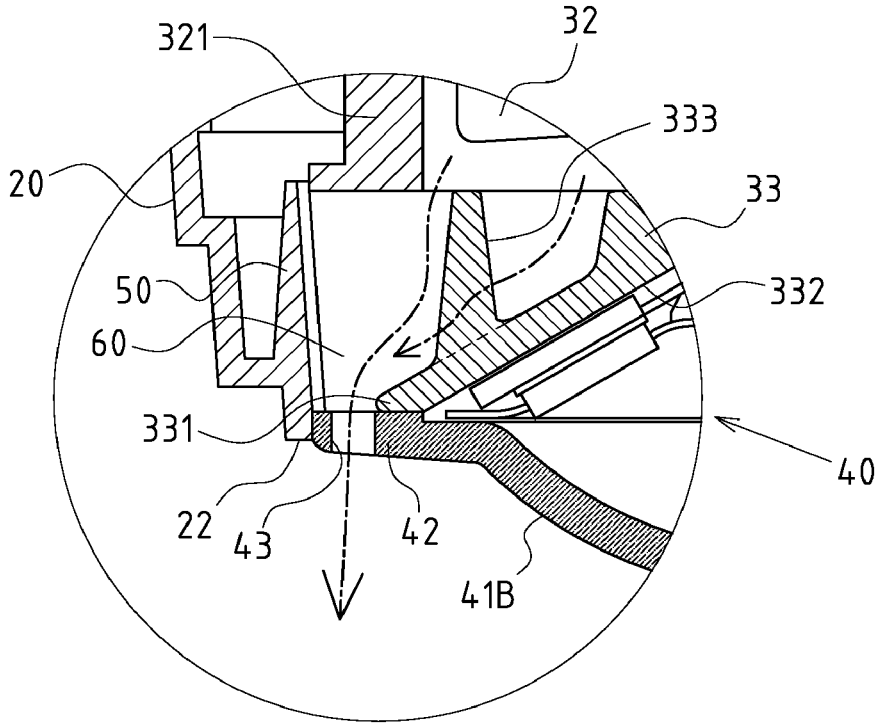
FIG. 10 shows a perspective view of another variation of the end-side heat extraction airflow guidance passage of the present invention.

In another embodiment shown in FIG. 10, the refraction mirror 41B of the LED lighting set 40 extends to form a barrier edge 42 blocking the outer end of the end-side heat extraction airflow guidance passage 60. Furthermore, an airflow passing hole 43 is configured on the barrier edge 42 to align with the end-side heat extraction airflow guidance passage 60.

We claim:

1. An end-side heat extraction LED lamp assembly comprising:

a lamp housing having an electrical connection adapter at one end thereof and a light projection end at an opposite end thereof and an inner housing space;

a cooling module positioned within said inner housing space of said lamp housing, said cooling module having a cooling fan and a cooling base, said cooling fan positioned within said cooling base, said cooling fan having an airflow guidance frame, said cooling base having a pedestal and an LED joint surface and multiple fins, said multiple fins having edges protruding outwardly from edges of said pedestal of said cooling base;

an LED lighting set positioned on said LED joint surface;

a circular frame extending from said airflow guidance frame of said cooling fan to said light projection end of said lamp housing; and at least one end-side heat extraction airflow guidance passage defined by a through space at the edges of said multiple fins and edges of said pedestal, an inner side of the end-side heat extraction airflow guidance passage corresponding to said cooling fan, an outer side of the end-side heat extraction airflow guidance passage corresponding to an end side of said light projection end of said lamp housing, the end-side heat extraction airflow guidance passage passing air from said cooling fan directly outwardly in a direction toward said light projection end, said LED joint surface having a refraction mirror, said refraction mirror extending so as to form a barrier edge blocking an outer end of said end-side heat extraction airflow guidance passage, said barrier edge having an airflow passing hole thereon aligned with said end-side heat extraction airflow guidance passage.

2. The end-side heat extraction LED lamp of claim 1, said circular frame integrally formed with said lamp housing.

3. The end-side heat extraction LED lamp of claim 1, said circular frame integrally formed on a periphery of said cooling base.

4. The end-side heat extraction LED lamp of claim 1, said circular frame being separately formed from said cooling base and said lamp housing.

5. The end-side heat extraction LED lamp of claim 1, said light projection end of said lamp housing having a ring-shaped edge supported on an outside end of said cooling base, said ring-shaped edge having through-holes aligned with the end-side heat extraction airflow guidance passage.

6. The end-side heat extraction LED lamp of claim 1, said LED joint surface having a refraction mirror, said refraction mirror being set against an edge of said pedestal of said cooling base, said refraction mirror having an edge defining a space with said circular frame that is aligned with said end-side heat extraction airflow guidance passage.

7. The end-side heat extraction LED lamp of claim 1, said cooling module having a circuit module attached to an inside of said cooling fan.

* * * * *